US008505340B2

(12) United States Patent
Kim et al.

(10) Patent No.: US 8,505,340 B2
(45) Date of Patent: Aug. 13, 2013

(54) FABRIC TREATING APPARATUS

(75) Inventors: Sung Min Kim, Seoul (KR); Dong Won Kim, Seoul (KR); Jong Seok Kim, Seoul (KR); Dae Yun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 877 days.

(21) Appl. No.: 12/654,492

(22) Filed: Dec. 22, 2009

(65) Prior Publication Data

US 2010/0154486 A1 Jun. 24, 2010

(30) Foreign Application Priority Data

Dec. 22, 2008 (KR) ..... 10-2008-0131733

(51) Int. Cl.
*B08B 3/12* (2006.01)

(52) U.S. Cl.
USPC ..... 68/5 C; 68/140; 68/5 R; 68/5 B; 68/5 E

(58) Field of Classification Search
USPC ..... 68/140, 5 R, 5 B, 5 C, 5 E
See application file for complete search history.

(56) References Cited

U.S. PATENT DOCUMENTS

| | | | | |
|---|---|---|---|---|
| 3,861,179 | A * | 1/1975 | Orchard | 68/6 |
| 5,107,606 | A * | 4/1992 | Tsubaki et al. | 34/596 |
| 8,250,885 | B2 * | 8/2012 | Han et al. | 68/3 R |
| 2004/0035155 | A1 * | 2/2004 | Yoon | 68/145 |

FOREIGN PATENT DOCUMENTS

| | | |
|---|---|---|
| CN | 101230537 A | 7/2008 |
| JP | 05-039498 | 5/1993 |
| JP | 2000-037598 | 2/2000 |
| JP | 2006-130157 | 5/2006 |
| KR | 10-2008-0098860 | 11/2008 |

* cited by examiner

*Primary Examiner* — Michael Barr
*Assistant Examiner* — Thomas Bucci
(74) *Attorney, Agent, or Firm* — McKenna Long & Aldridge LLP

(57) ABSTRACT

A present invention relates to a fabric treating apparatus including an inside cabinet which forms a treating chamber in which the fabrics treated, and a heating unit for supplying any one between hot wind and steam to the treating chamber, and a driving unit for generating driving power, and a driving unit frame is disposed the upper side of the inside cabinet for fixing the driving unit, and a sealing unit is pressed by the driving unit frame and penetrates the driving unit frame and the inside cabinet.

18 Claims, 7 Drawing Sheets

FABRIC TREATING APPARATUS

This application claims priority from Korean Patent Application No 10-2008-0131733 filed on Dec. 22, 2008, in the Korean Intellectual Property Office, the disclosure of which is incorporated herein by reference in its entirety.

BACKGROUND

1. Field

The present invention relates to fabric treating apparatus for preventing the air leakage from a treating chamber to the outside.

2. Background

Fabric treating apparatus includes all devices for managing or treating fabrics at home or in the laundry shops, such as washing, drying, removing of the wrinkles.

For example, the fabrics treating apparatus includes a washing machine for washing fabrics, a dryer for drying fabrics, a washing and drying machine having both washing function and drying function, a refresher for refreshing fabrics, and a steamer for removal of unnecessary wrinkles from fabrics The refresher is a device for making fabrics more comfortable or refreshing. The refresher performs functions of drying fabrics or supplying aroma to the fabrics or preventing generation of static electricity or removing the wrinkles from the fabrics.

The steamer is a device for merely supplying steam to fabrics for removing the wrinkles from the fabrics. The steamer removes the wrinkles more finely than a general iron, because a hot plate avoids is not contacted with the fabrics.

The fabrics treating apparatus which has functions of the steamer as well as the refresher performs functions of removing the wrinkles and the smells from the fabrics loaded in the fabrics treat apparatus using the steam and hot wind.

By these functions, the fabrics loaded in the fabrics treating apparatus can be ironing effect by removing of smelling particles or wrinkles which pollutes the fabrics. And also, it can increase the effect by moving the fabrics using the steam and hot wind.

In the case of conventional fabric treating apparatus, a hanger bar is disposed to move in a treating chamber, and a driving unit is disposed for driving the hanger bar in the outside of the treating chamber. A rotary shaft for transmitting a power from the driving unit penetrates the treating chamber. Thus, the humid air in the treating chamber may leak from a gap between the rotary shaft and a hole penetrated by the rotary shaft. The humid air leaking from the treating chamber may contact the driving unit, may thus cause damage to the driving unit. A durability of the fabric treating apparatus may go bad.

BRIEF SUMMARY OF THE INVENTION

The present invention provides a fabric treating apparatus for preventing the air leakage from a treating chamber to the outside.

According to an aspect of the present invention, a fabric treating apparatus includes an inside cabinet which forms a treating chamber which the fabrics treated in, a heating unit for supplying any one between hot wind and steam to the treating chamber, a driving unit is disposed outside the treating chamber for generating driving power, a power transmission unit is disposed to penetrate the inside cabinet for transmitting the driving power of the driving unit to the treating chamber; and a sealing unit for sealing a gap between the power transmission unit and the inside cabinet.

The driving unit may generate a rotary power, and the power transmission unit may transmit the rotary power.

The power transmission unit may include a rotary shaft which penetrates the inside cabinet and the sealing unit includes a bearing for supporting the rotary shaft, and a sealing tube is mounted on the inside cabinet for sealing a gap between the bearing and the inside cabinet. The bearing may include a bearing in which the rotary shaft inserts. Also, the bearing may use an oilless bearing.

The fabric treating apparatus may further include a driving unit frame for holding the driving unit. The sealing tube may include a sealing plate pressed by the driving unit frame.

The driving unit frame includes a main frame contacted the lower side of the sealing plate and a sub frame contacted the upper side of the sealing plate.

Also, the fabric treating apparatus may further include a fixing part for fixing the sub frame to the main frame. The sealing plate is elastic material.

The sealing tube may include a insertion portion for inserting in the inside cabinet to mount on the inside cabinet.

The fabric treating apparatus may further include a connecting rod connected with the rotary shaft and a hanger unit is disposed the upper part of the treatment chamber and reciprocates by the connecting rod.

The connecting rod may include a rotary shaft connector which is connected to the rotary shaft and a rotary arm which is extended in the perpendicular direction from the rotary shaft connector and a slot connector which is formed at the end of the rotary arm and is inserted to the hanger unit.

The hanger unit may include a slot is formed long in the perpendicular direction of the reciprocating direction of the hanger unit to insert the slot connector.

According to another aspect of the present invention, a fabric treating apparatus includes an inside cabinet which forms a treating chamber which the fabrics treated in and a heating unit for supplying any one between hot wind and steam to the treating chamber, and a driving unit is disposed outside the treating chamber for generating a rotary power, and a driving unit frame for holding the driving unit and a rotary shaft which penetrates the driving unit frame and the inside cabinet transmits a rotary power of the driving unit, and a sealing tube which the rotary shaft penetrates into is hold by the driving unit frame and the inside cabinet for sealing a gap between the driving unit frame and the inside cabinet.

The sealing tube may include a body portion which the rotary shaft inserts into is formed in the shape of a tube and a sealing plate is protruded from the body portion and is pressed by the driving unit frame.

The driving unit frame may include a main frame contacted the one side of the sealing plate and a sub frame contacted the other side of the sealing plate.

The fabric treating apparatus may further include a bearing for supporting the rotary shaft and for sealing a gap between the rotary shaft and the driving unit frame.

DETAILED DESCRIPTION

The above and other advantages of the present invention will become more apparent by describing in detail embodiments thereof with reference to the attached drawings in which.

The present invention is not restricted by the following embodiments. It will be understood by those of ordinary skill in the art that various changes in form and details may be made therein without departing from the spirit and scope of the present invention as defined by the following claims.

The present invention will hereinafter be described in detail with reference to the accompanying drawings in which exemplary embodiments of the invention are shown.

Figure 1:
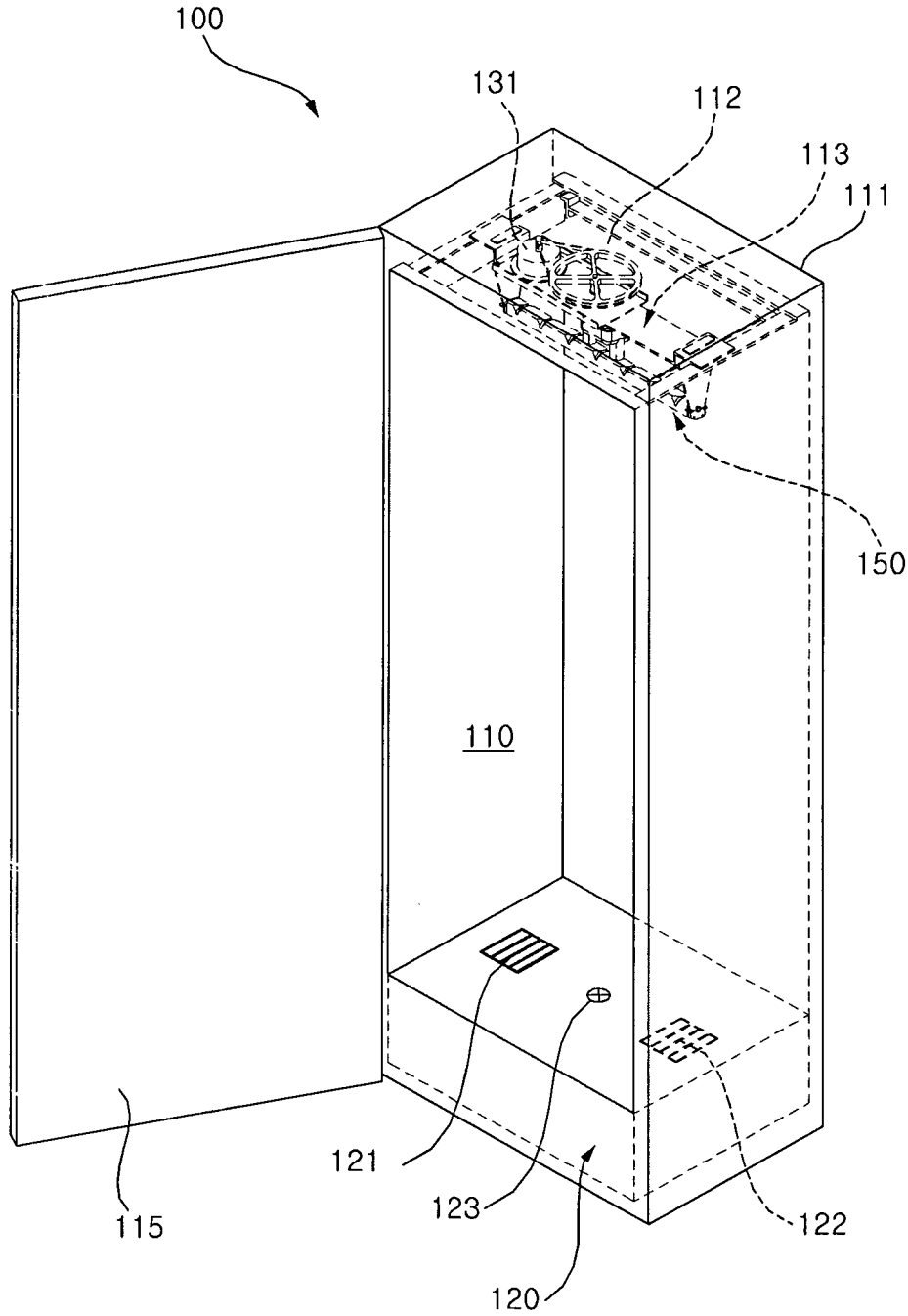
FIG. 1 illustrates a perspective view of a fabric treating apparatus in accordance with an exemplary embodiment of the present invention.
Figure 2:
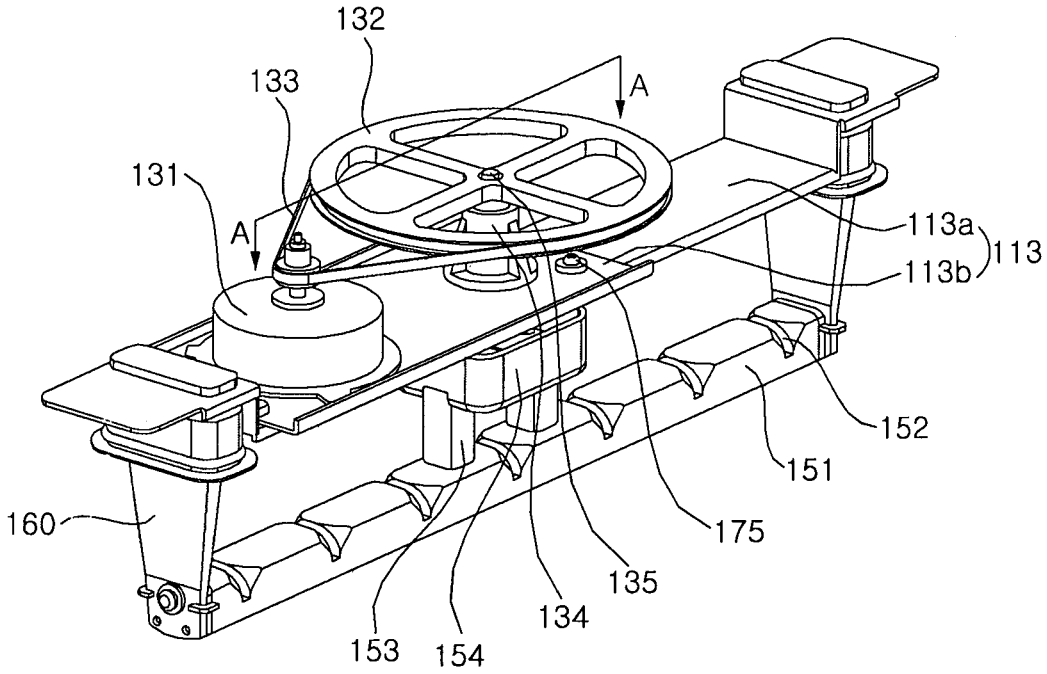
FIG. 2 illustrates partial enlarged perspective view of FIG. 1 for showing a motion of a hanger unit.
Figure 3:
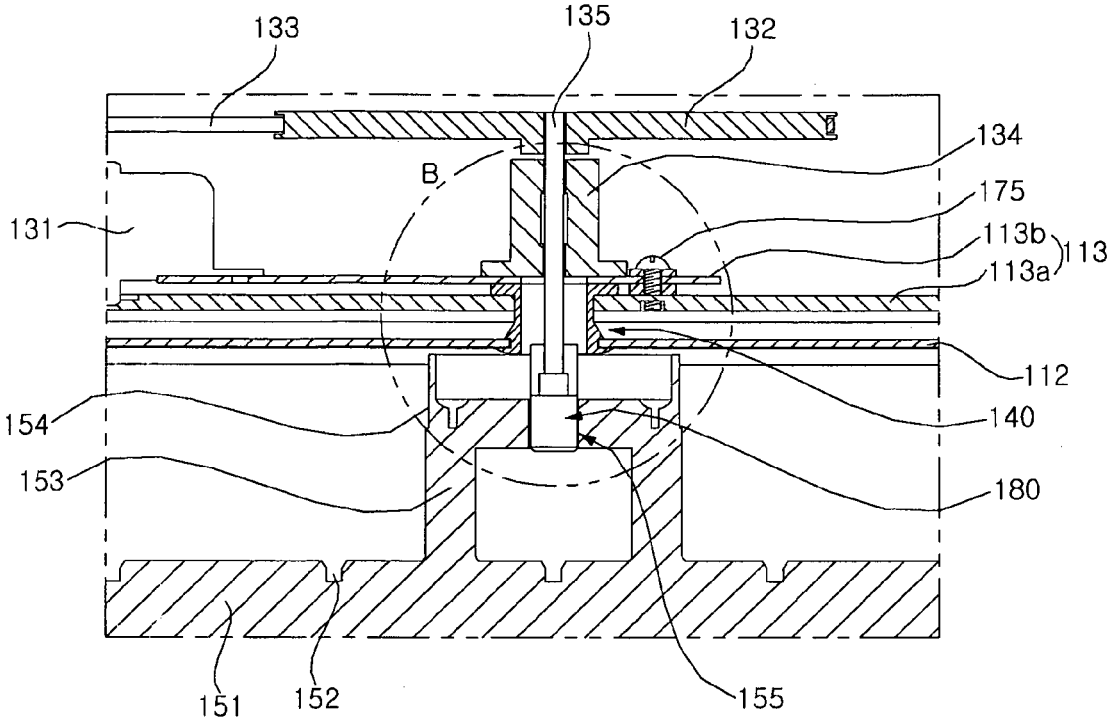
FIG. 3 illustrates a cross-sectional view according to A-A line shown in FIG. 2.

FIG. 1 illustrates a perspective view of a fabric treating apparatus in accordance with an exemplary embodiment of the present invention. FIG. 2 illustrates partial enlarged perspective view of FIG. 1 for showing a motion of a hanger unit. FIG. 3 illustrates a cross-sectional view according to A-A line shown in FIG. 2.

Referring FIG. 1~4, a fabric treating apparatus 100 includes an outside cabinet 111 which forms the exterior of the fabrics treating apparatus, and an inside cabinet 112 which is disposed in the outside cabinet 111. The inside cabinet 112 includes a treating chamber 110 which the fabrics treated in.

The treating chamber 110 has an opening at the side, and thus, a fabric can be loaded in the treating chamber 110 through the opening. A door 115 is disposed so as to be able to open or close the opening. If the door 115 is closed, the treating chamber 110 is isolated from the exterior. If the door 115 is opened, the treating chamber 110 is exposed to the exterior. A user opens the door 115, and then puts the fabrics in the treating chamber 110. The user closes the door 115, and then operates the fabric treating apparatus 100.

The treating chamber 110 is a space for treating a fabric to be changed the physical or chemical properties of the fabrics by supplying a steam or hot wind. Namely, the treating chamber 110 is a space for treating the fabrics by using different method. For example, in the treating chamber 110, the fabrics can be dried by using a hot wind, or the wrinkles of the fabrics can be removed by using a steam, or the fabrics can be supplied aroma by spraying an aromatic, or the generation of static electricity of the fabrics can be prevented by spraying an antistatic.

The fabric treating apparatus 100 includes a heating unit 120 for supplying any one between hot wind and steam to the treating chamber 110. The heating unit 120 is able to heat the air inhaled from the treating chamber 110, and to supply the hot wind to the inside of the treating chamber 110. Also, the heating unit is able to generate a steam by heating the water, and to supply the steam to the inside of the treating chamber 110. Of course, the heating unit 120 is able to supply both the hot wind and the steam.

The heating unit 120 in accordance with an exemplary embodiment of the present invention includes an air inlet 121 for inhaling the air from the inside of the treating chamber 110, and a heater (not shown) for heating the air inhaled, and a fan (not shown) for blowing the air heated by the heater, and an outlet 122 for discharging the hot wind heated by the heater to the inside of the treating chamber 110, and an injection nozzle 123 for injecting a steam to the inside of the treating chamber 110.

In the exemplary embodiment of the present invention, the heating unit 120 may be embodied the circulation type that the heating unit 120 inhales the air from the treating chamber 110 and then discharges the air to the treating chamber. Thus, it may be able to increase energy efficiency. But, the heating unit 120 will be understood by those of ordinary skill in the art that various changes in form and details may be made therein without departing from the spirit and scope of the present invention. For example, the heating unit 120 inhales the air from the outside of the treating chamber 110 and heats the air inhaled, and then discharges the air to the inside of the treating chamber 110.

The hot wind or the steam generated by the heating unit 120 supplies to the fabrics loaded in the treating chamber 10, and has an influence on the physical property or the chemical property of the fabrics. Namely, the hot wind or the steam makes the structure of the fabrics to be relaxed, so that the wrinkles of the fabrics can be removed. The steam reacts to the smell particles of the fabrics, so that an unpleasant smell can be removed. Also, the hot wind or the steam generated by the heating unit 120 has a sterilization effect on bacteria of the fabrics.

A hanger unit 150 is disposed the upper part of the treatment chamber 110 to be able to reciprocate. A plurality of hangers (not shown) is hung on the hanger unit 150. The hanger unit 150 is able to reciprocate if a plurality of hanger is hung on the hanger unit 150.

The fabric treating apparatus 100 further includes a driving unit 131 for reciprocating the hanger unit 150. The driving unit 131 may include a motor for generating a rotary power. The driving unit 131 is disposed a space between the inside cabinet 112 and the outside cabinet 111 for preventing a mechanical trouble or a damage of the parts which may be caused by an air of high temperature and humidity.

The driving unit 131 is mounted on a driving unit frame 113. The driving unit frame 113 is fixed in the upper side of the inside cabinet 112.

Figure 4:
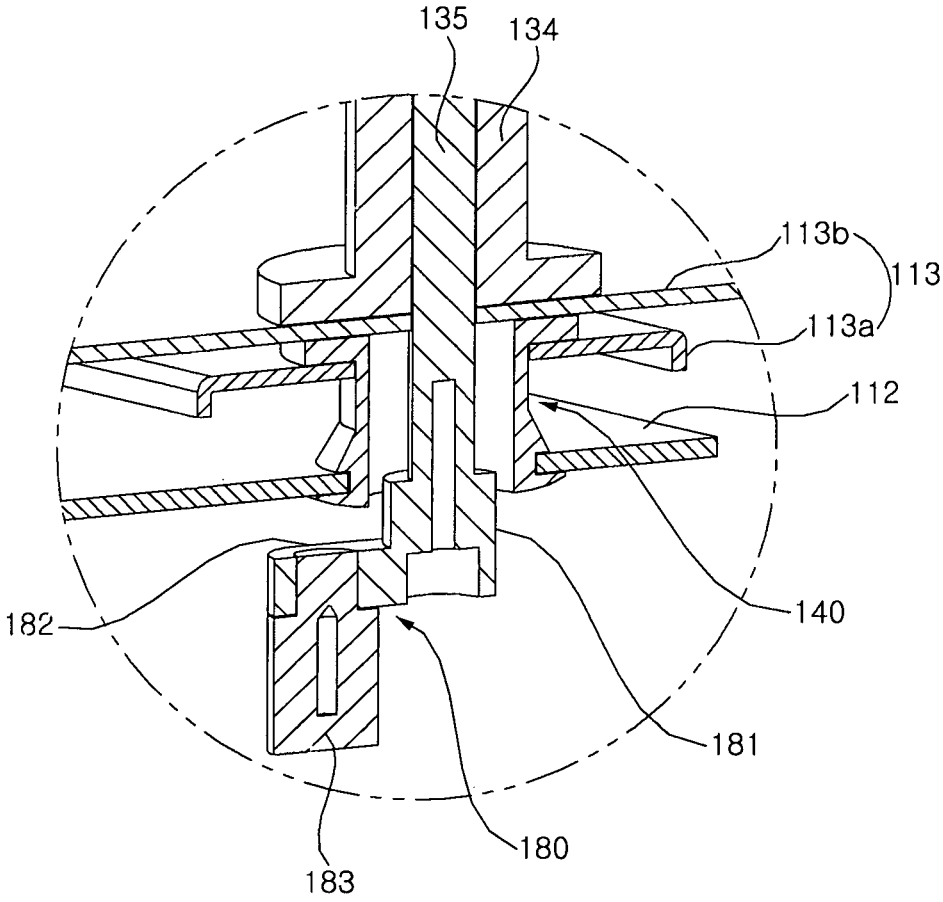
FIG. 4. illustrates an enlarged cross-sectional view of B part shown in FIG. 3.

Refer to FIG. 2 and FIG. 4, the fabric treating apparatus 100 may further include a power transmission unit which transmits the rotary power of the driving unit 131 to the treating chamber 110. The power transmission may include a belt 133 which transmits the rotary power of the driving unit 131, a pulley 132 which is rotated by the belt 133 and a rotary shaft 135 which is rotated by the pulley 132. The rotary shaft 135 is disposed for penetrating the inside cabinet 112 and the driving unit frame 113.

Also, the fabric treating apparatus 100 further includes a sealing unit for sealing a gap between the power transmission unit and the inside cabinet 112. The sealing unit may be able to prevent the air leakage from a treating chamber 110 to the outside which may be caused by penetrating the power transmit unit to the inside cabinet 112.

More specifically, in the fabric treating apparatus according to the exemplary embodiment, the rotary shaft 135 included in the power transmit unit penetrates the inside cabinet 112. In this case, it is necessary that the sealing unit prevents the air leakage through the gap between the rotary shaft 135 and the inside cabinet 112. The sealing unit may include a sealing tube 140 which is fixed by the inside cabinet 112 and the driving unit frame 113, and a bearing 134 is mounted on the upper side of the driving unit frame 113 for supporting the rotary shaft 135 to be able to rotate.

The bearing 134 may include a bearing which the rotary shaft 135 is inserted into. The bearing may be use an oilless bearing. The bearing 134 is disposed to be contacted with the driving unit frame 113 for preventing the air leakage from the treating chamber 110 which may be caused by penetrating of the rotary shaft 135 to the driving unit frame 113.

The driving unit frame 113 includes a main frame 113*a* is fixed in the space between the outside cabinet 111 and the inside cabinet 112, and a sub frame 113*b* on which the driving unit 131 and the bearing 134 is mounted is connected with the main frame 113*a* by a fixing part 175

Refer to FIG. 4, a connecting rod 180 which may be able to reciprocate a hanger unit 150 connects with the end of the rotary shaft 135. The connecting rod 180 includes a rotary shaft connector 181 which is connected to the rotary shaft 135, and a rotary arm 182 which is extended in the perpendicular direction from the rotary shaft connector 181, and a slot connector 183 which is formed at the end of the rotary arm 182 and is inserted to the slot 155 (refer to FIG. 5) of the hanger unit 150.

Figure 5:
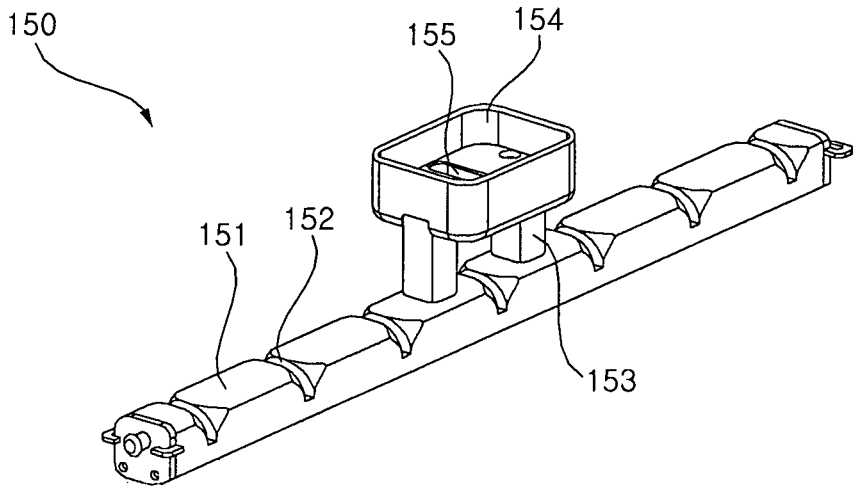
FIG. 5. illustrates a perspective view of a hanger unit according to an exemplary embodiment of the present invention.

FIG. 5. illustrates a perspective view of a hanger unit 150 according to an exemplary embodiment of the present invention.

Refer to FIG. 5, the hanger unit 150 may include a hanger rack 151 is formed in the shape of a rod, and a hanger slot 152 on which a hanger is hung, and a cover part 154 including a slot 155 in which the slot connector 183 of the connecting rod 180 inserts, and a connector 153 for connecting the hanger rack 151 and the cover part 154. When the door 115 is opened, the cover part 154 covers the unnecessary parts including the connecting rod 180 so as not to expose to the user. It has an effect on improving the aesthetics of the apparatus and giving a feeling of the high class apparatus.

The slot 155 may be formed long in the perpendicular direction of the reciprocating direction of the hanger unit 150. For example, if the hanger unit 150 reciprocates from the left to right, the slot 155 is formed long from the back and forth.

The slot 155 is formed long in the direction of the back and forth. Thus, a motion of the connecting rod 180 in the direction of back and forth may be offset by the slot 155 when the slot connector 183 of the connecting rod 180 is inserted in the slot 155 and rotates the rotary shaft 145. Therefore, the hanger unit 150 merely reciprocates in the direction of left and right.

Refer to FIG. 2., the hanger unit 150 is hung by a supporter 160 in the upper part of the treating chamber 110. The supporter 160 may be connected the both end of the hanger rod 151. The supporter 160 may be elastic material for supporting the hanger unit 150 so as to reciprocate within the required range. The supporter 160 is shaped of the long plate in the direction of back and forth for limiting a reciprocating motion of the hanger unit 150.

Figure 6:
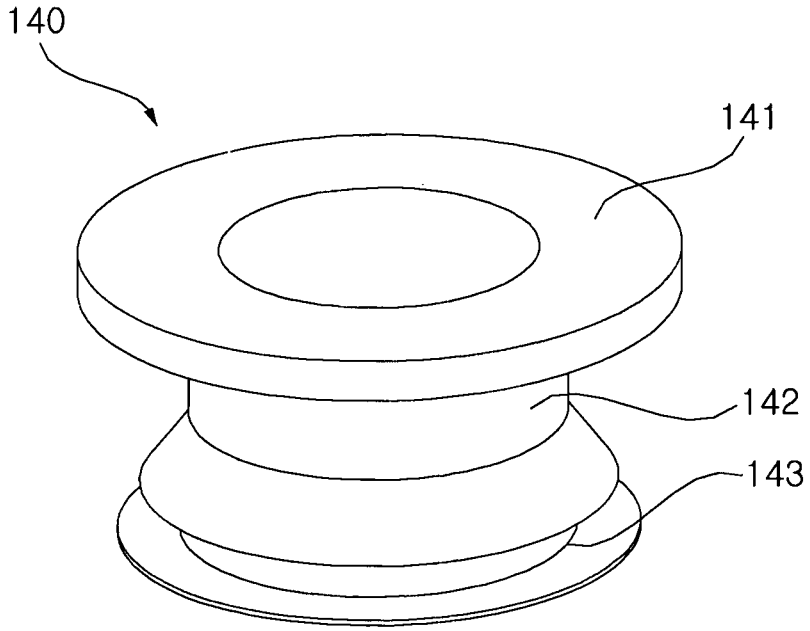
FIG. 6. illustrates a perspective view of a sealing tube according to an exemplary embodiment of the present invention.
Figure 7:
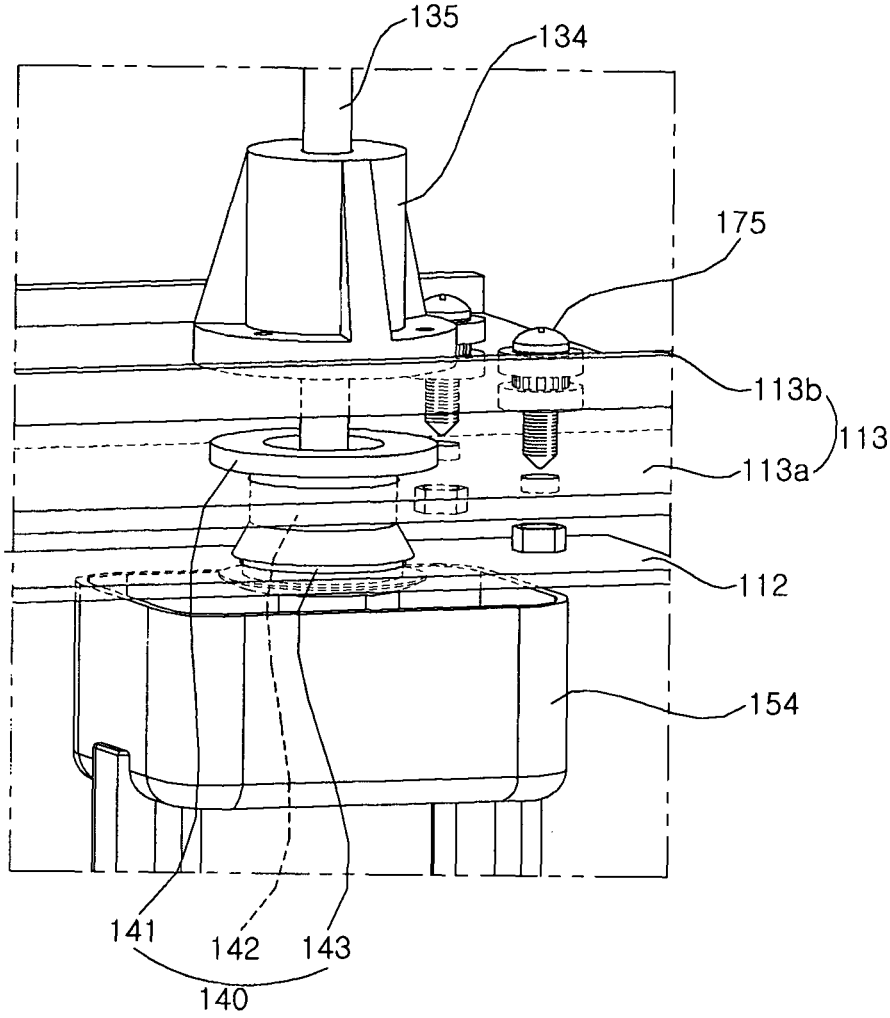
FIG. 7. illustrates an exploded perspective view for showing the assembling structure of a sealing tube and a driving unit according to an exemplary embodiment of the present invention.
Figure 8:
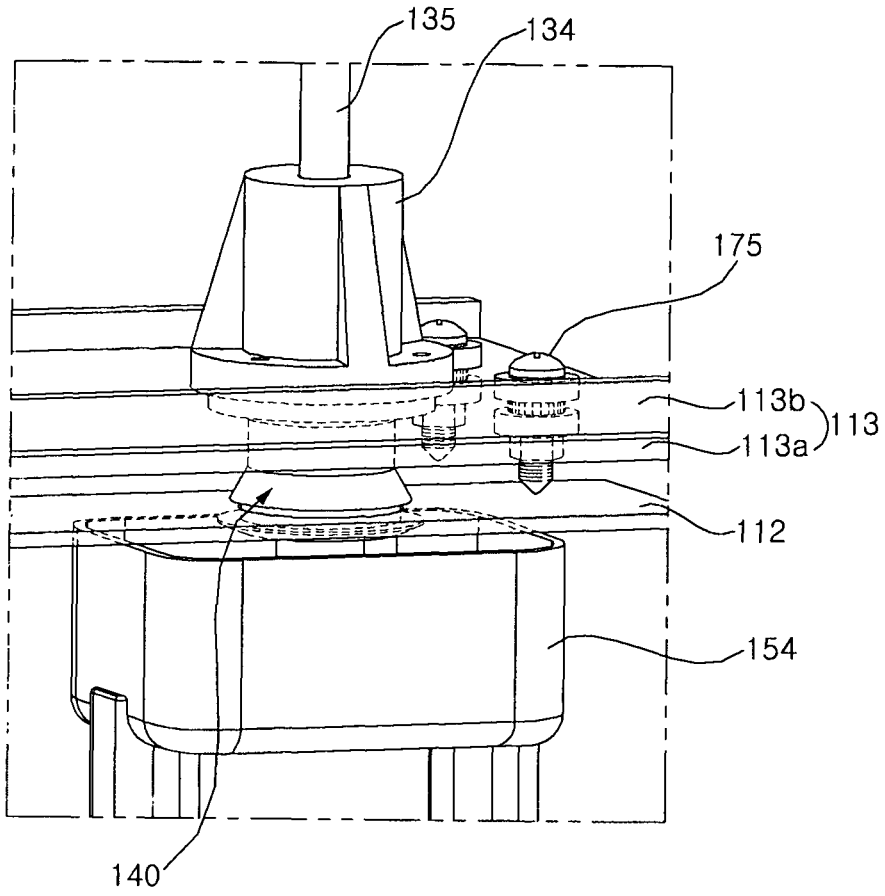
FIG. 8. illustrates a perspective view for showing the sealing tube pressed by the driving unit frame according to an exemplary embodiment of the present invention.

FIG. 6. illustrates a perspective view of a sealing tube 140 according to an exemplary embodiment of the present invention. FIG. 7. illustrates an exploded perspective view for showing the assembling structure of a sealing tube 140 and a driving unit according to an exemplary embodiment of the present invention. FIG. 8. illustrates a perspective view for showing the sealing tube 140 pressed by the driving unit frame 113 according to an exemplary embodiment of the present invention.

Refer to FIGS. 6 through 8, the sealing tube 140 may include a body portion in which the rotary shaft 135 penetrating the driving unit frame 113 and the inside cabinet 112 inserts, and a sealing plate 141 is protruded from the one end of the body portion 142, and a insertion portion 143 is depressed at the another end of the body portion 142 for inserting in the inside cabinet 112

The diameter of the body portion 142 is larger than the diameter of the rotary shaft 135, so that the rotary shaft 135 penetrated into the body portion 142 may rotate smoothly. In the case, there is a space between the rotary shaft 135 and the body portion 142. An air of high temperature and humidity of the treating chamber 110 flows to the space The sealing plate 141 is pressed by the driving unit frame 113 for sealing a gap between the driving unit frame 113 and the sealing plate. Thus, the sealing plate 141 may prevent that an air of high temperature and humidity soaks into the driving unit 131 through the gap The sealing plate 141 may be shaped of the plate so as to contact with the driving unit frame 113 more widely. Also, the sealing plate 141 may be elastic material so as to seal more effectively when the sealing plate is pressed by the driving unit frame 114.

In the exemplary embodiment of the present invention, the sealing tube 140 is one body. Thus, the sealing tube 140 may be elastic material. But, the sealing tube 140 may not be one body. In the case, a part of the sealing tube 140 may be elastic material.

The sealing plate 141 may be pressed by the driving unit frame 113 for sealing a gap between the sealing plate 141 and the driving unit frame.

In the exemplary embodiment of the present invention, the driving unit frame 113 includes a main frame 113*a* and a sub frame 113*b*. The lower side of the sealing plate 141 contacts the main frame 113*a*. The upper side of the sealing plate 141 contacts the sub frame 113*b*. The sealing plate 141 is mounted on the gap between the main frame 113*a* and the sub frame 113*b*, and then the main frame 113*a* and the sub frame 113*b* is fixed by a fixing part 175. The gap between the sealing plate 141 and the main frame 113*a* and the gap between the sealing plate 141 and the sub frame 113*b* are sealed by the fixing power of the fixing part 175.

The bottom end of the sealing tube 140 is fixed by the inside cabinet 112 inserted to the insertion part 143. The top side of the sealing tube 140 is sealed by the bearing 134.

In the exemplary embodiment of the present invention, the driving unit frame 113 consists of two frames. But, the driving unit frame 113 may consists of one frame, the one side of the sealing plate 141 pressed by the frame may seal a gap. Namely, the scope of the present invention is not defined a number of the driving unit frame 113.

A fabric treating apparatus according to the present invention, it is possible to prevent an air leakage from a treating chamber to the outside.

Also, according to a fabric treating apparatus according to the present invention, a sealing unit is pressed by a driving unit frame. Therefore, it is possible to prevent an air leakage from a treating chamber through a gap between a sealing unit and a rotary shaft.

Also, according to a fabric treating apparatus according to the present invention, it is possible to prevent a damage of the parts is disposed at the outside of the treating chamber. Therefore, it has an effect on improving durability of the apparatus.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A fabric treating apparatus, comprising:

an inside cabinet defining at least a portion of a treating chamber within which the fabrics are treated;

a heating unit configured to supply heated air, or steam, or heated air and steam to the treating chamber;

a driving unit, disposed outside the treating chamber, configured to generate a driving power;

a power transmission unit, coupled to the driving unit, configured to transmit the driving power of the driving unit to an assembly within the treating chamber through an opening in a wall of the inside cabinet, wherein the power transmission unit comprises:

a rotary shaft which penetrates the inside cabinet through the opening;

a sealing unit configured to seal a gap in the opening between the power transmission unit and the inside cabinet, wherein the sealing unit comprises:

a bearing assembly configured to support the rotary shaft; and a sealing tube having a first end and a second end spaced apart from the first end, the first end coupled to the bearing assembly and the second end coupled to the inside cabinet;

a connecting rod coupled to the rotary shaft; and a hanger unit coupled to the connecting rod, wherein the hangar unit travels in a reciprocating direction when driven by the rotary shaft.

2. The fabric treating apparatus of claim 1, wherein the driving power is rotary power.

3. The fabric treating apparatus of claim 1, wherein the rotary shaft passes through the bearing assembly.

4. The fabric treating apparatus of claim 1, wherein the bearing assembly is an oilless bearing assembly.

5. The fabric treating apparatus of claim 1, further comprising a driving unit frame configured to support the driving unit, wherein the sealing tube contacts the driving unit frame at a sealing plate located at the first end of the sealing tube.

6. The fabric treating apparatus of claim 5, wherein the sealing plate has an upper surface and a lower surface, the lower surface closer to the opening than the upper surface;

wherein the driving unit frame comprises:

a main frame, configured to contact the lower surface of the sealing plate; and a subframe, configured to contact the upper surface of the sealing plate.

7. The fabric treating apparatus of claim 6, further comprising a fixing part configured to fix the sub frame to the main frame.

8. The fabric treating apparatus of claim 5, wherein the sealing plate is comprised of elastic material.

9. The fabric treating apparatus of claim 1, wherein the sealing tube comprises an insertion portion configured to receive the opening around the circumference of the opening.

10. The fabric treating apparatus of claim 1, wherein the connecting rod comprises:

a rotary shaft connector connected to the rotary shaft;

a rotary arm extended from the rotary shaft connector in a direction perpendicular to an axis of rotation of the rotary shaft; and a slot connector extending from the rotary arm toward an interior of the treating chamber and in a direction parallel to the axis of rotation of the rotary shaft.

11. The fabric treating apparatus of claim 1, wherein the hanger unit comprises a slotted opening formed perpendicular to the reciprocating direction, and wherein the slot connector is received in the slotted opening.

12. A fabric treating apparatus, comprising:

an inside cabinet defining at least a portion of a treating chamber within which the fabrics are treated;

a heating unit configured to supply heated air, or steam, or heated air and steam to the treating chamber;

a driving unit, disposed outside the treating chamber, configured to generate a rotary driving power;

a driving unit frame configured to mount the driving unit;

a rotary shaft to transmit the rotary driving power of the driving unit from outside the treating chamber to inside the treating chamber;

a sealing tube coupled at a first end to the driving unit frame and at a second end, spaced apart from the first end, to the inside cabinet, the rotary shaft passing from outside the treating chamber to inside the treating chamber through the sealing tube, the sealing tube configured to seal a space between the rotary shaft and the inside cabinet;

a connecting rod coupled to the rotary shaft; and a hanger unit coupled to the connecting rod, wherein the hangar unit travels in a reciprocating direction when driven by the rotary shaft.

13. The fabric treating apparatus of claim 12, wherein the sealing tube comprises a body portion in a shape of a tube to receive the rotary shaft in pass-through penetration; and a sealing plate extending from a circumference of the tube and in a direction perpendicular to an axis of rotation of the rotary shaft within the tube, and configured to contact a surface of the driving unit frame.

14. The fabric treating apparatus of claim 13, wherein the sealing plate has an upper surface and a lower surface, the lower surface closer to the inside cabinet than the upper surface;

wherein the driving unit frame comprises:

a main frame, configured to contact the lower surface of the sealing plate; and a subframe, configured to contact the upper surface of the sealing plate.

15. The fabric treating apparatus of claim 14, further comprising a fixing part configured to fix the sub frame to the main frame.

16. The fabric treating apparatus of claim 13, further comprising a bearing configured to support the rotary shaft and to seal a gap between the rotary shaft and the driving unit frame at a location where the rotary shaft penetrates the driving unit frame.

17. The fabric treating chamber of claim 16, wherein the bearing comprises an oilless bearing into which the rotary shaft is received.

18. The fabric treating chamber of claim 12, wherein the sealing tube comprises an insertion portion configured to receive an edge of the inside cabinet in a location where the rotary shaft penetrates the inside cabinet.

* * * * *